US006817050B2

(12) United States Patent
Mileti

(10) Patent No.: US 6,817,050 B2
(45) Date of Patent: Nov. 16, 2004

(54) EXPANDABLE BLADDER

(75) Inventor: Robert J. Mileti, Torrington, CT (US)

(73) Assignee: Trlby Innovative LLC, Torrington, CT (US)

( * ) Notice: Subject to any disclaimer, the term of this patent is extended or adjusted under 35 U.S.C. 154(b) by 2 days.

(21) Appl. No.: 10/382,416

(22) Filed: Mar. 6, 2003

(65) Prior Publication Data

US 2003/0167572 A1 Sep. 11, 2003

Related U.S. Application Data

(60) Provisional application No. 60/361,928, filed on Mar. 6, 2002.

(51) Int. Cl.[7] ..... A47C 27/08

(52) U.S. Cl. ..... 5/706; 5/655.3; 5/644; 5/710

(58) Field of Search ..... 5/655.3, 706, 644, 5/710

(56) References Cited

U.S. PATENT DOCUMENTS 3,899,797 A * 8/1975 Gunst ..... 5/655.3
4,236,264 A * 12/1980 Britzman ..... 5/644
4,899,406 A * 2/1990 Sanderson et al. ..... 5/655.3
4,928,336 A * 5/1990 Petillo, Sr. ..... 5/655.3
5,445,274 A * 8/1995 Pharo ..... 206/522
6,065,167 A * 5/2000 Gancy ..... 5/655.3

* cited by examiner

*Primary Examiner*—Frederick L. Lagman
(74) *Attorney, Agent, or Firm*—St. Onge Steward Johnston & Reens LLC.

(57) ABSTRACT

The invention relates to an expandable bladder, and method for making same, having an interior sheet and an exterior sheet extending from a left direction toward a right direction and where the exterior sheet has an inner side and an outer side. The interior sheet is coupled to the inner side of the exterior sheet where the outer side is facing upwardly and the inner side is facing downwardly. The exterior sheet has at least one fold where, upon being subjected to bending, the at least one fold unfolds to provide additional material so that exterior sheet maintains a distance from the interior sheet.

18 Claims, 9 Drawing Sheets

EXPANDABLE BLADDER

RELATED APPLICATIONS

This application claims the benefit under 35 U.S.C. §119 (e) of U.S. Provisional Application No. 60/361,928, filed Mar. 6, 2002.

FIELD OF THE INVENTION

The invention relates to an expandable bladder having an interior sheet and an exterior sheet that provides a distance between the interior and exterior sheets whether or not the bladder is bent.

BACKGROUND OF THE INVENTION

Padding elements may be used for a variety of purposes, including packaging for protecting contents within the package, mattresses for providing adequate support to all areas of a user's body while minimizing the hammocking effect, which is where the mattress bows and leaves voids such as the neck and lower back without support, and inflatable structures to provide integrity while reducing injury. Although padding elements may be suitable for some applications, they may be unsuitable for other applications. For example, Styrofoam boards may provide adequate protection to contents during shipment along a length of a package but may not provide adequate protection around corners because Styrofoam is often difficult to bend without breaking. Another example is an inflatable device that uses air to protect contents of a package. These devices may be easier to maneuver around a corner but, during bending, walls of the devices often collapse onto one another, in which case air is displaced away from the corner, thereby subjecting the contents to damage in this area.

U.S. Design Pat. No. 257,200 to LaRocca ("LaRocca"), U.S. Pat. No. 4,482,054 to Gardner ("Gardner"), U.S. Pat. No. 2,715,231 to O. F. Marston ("Marston"), U.S. Pat. No. 3,346,101 to J. A. Pestka ("Pestka"), U. S. Pat. No. 4,697,290 to Alklind et al. ("Alklind"), and U.S. Pat. No. 5,180,060 to Forti et al. ("Forti") seem to disclose structures having crimped sections to facilitate bending. However, due to the crimped sections, the references do not appear to provide a distance between the interior and exterior sheets during bending and, hence, the interior and exterior sheets seem to come together and may also touch, thereby possibly reducing structural integrity in favor of bendability.

U.S. Pat. No. 974,871 to J. T. Ferres ("Ferres") and U.S. Pat. No. 6,073,770 to Park ("Park") seem to disclose a non-expandable, fixed structure for packaging and, hence, bending appears to be difficult. U.S. Pat. No. 5,727,270 to Cope et al. ("Cope"), U.S. Pat. No. 5,139,151 to Chelak ("Chelak"), and U.S. Pat. No. 5,445,274 to Pharo ("Pharo") seem to disclose structures that have generally parallel sheets of material for containing air or another substance. However, upon being bent, the sheets in Cope, Chelak, and Pharo appear to collapse onto one another where the distance between the sheets is no longer maintained, thereby possibly reducing the effectiveness of the packaging.

U.S. Pat. No. 4,197,681 to Holcombe ("Holcombe") appears to relate to an inflatable structure having bends or elbows to permit the structure to orient members at various angles. To achieve a bend, the Holcombe appears to remove material from an interior part of the bend. Although this may provide a distance between interior and exterior parts of the bend, removing material often reduces structural integrity.

What is desired, therefore, is a device that maintains adequate protection whether or not it is subjected to bending.

Another desire is a device that has walls spaced apart from each other to protect contents on one side of one wall from damaging elements in contact with the other wall and that this distance between the walls be maintained during bending of the device.

SUMMARY OF THE INVENTION

Accordingly, it is an object of the invention to provide a device that maintains a distance between an interior part of a bend and an exterior part of the bend.

Another desire is to provide a device that facilitates bending without sacrificing structural integrity These and other objects of the invention are achieved by provision of an expandable bladder having an interior sheet and an exterior sheet extending from a left direction toward a right direction and where the exterior sheet has an inner side and an outer side. The interior sheet is coupled to the inner side of the exterior sheet where the outer side is facing upwardly and the inner side is facing downwardly.

The exterior sheet has a first fold defined by a first part and a second part and the second part of the first fold is folded onto the first part of the first fold, whereby the first part of the first fold extends from a left direction toward a right direction and the second part of the first fold extends from a right direction toward a left direction.

The exterior sheet has a second fold following the first fold, the second fold defined by a first part and a second part and the second part of the second fold is folded onto the first part of the second fold, whereby the first part of the second fold extends from a right direction toward a left direction and the second part of the second fold extends from a left direction toward a right direction.

In some embodiments, the expandable bladder may couple the first and second folds with the interior or exterior sheet.

In other embodiments, the first and second folds may be cyclically repetitive along the exterior sheet and may be as numerous as desired for adequate bending of the expandable bladder.

The outer side of the first and second folds face upwardly and the inner side of the first and second folds face downwardly when a substance is placed between the interior and exterior sheets and, when the interior and exterior sheets are subjected to bending, the interior and exterior sheets provide a space between them.

In another embodiment, the expandable bladder's exterior sheet includes a third fold following the second fold, the third fold defined by a first part and a second part and the second part of the third fold is folded onto the first part of the third fold, whereby the first part of the third fold extends from a left direction toward a right direction and the second part of the third fold extends from a right direction toward a left direction.

The exterior sheet also has a fourth fold following the third fold, the fourth fold defined by a first part and a second part and the second part of the fourth fold is folded onto the first part of the fourth fold, whereby the first part of the fourth fold extends from a right direction toward a left direction and the second part of the fourth fold extends from a left direction toward a right direction.

In another embodiment, the expandable bladder is limited to the component that uses the bladder. The component may include a mattress, packaging material, or an inflatable structure.

The invention and its particular features and advantages will become more apparent from the following detailed description considered with reference to the accompanying drawings.

BRIEF DESCRIPTION OF THE DRAWINGS

FIGS. 2*a* and 2*b* depict another embodiment of the expandable bladder

DETAILED DESCRIPTION OF THE DRAWINGS

Figure 1B:
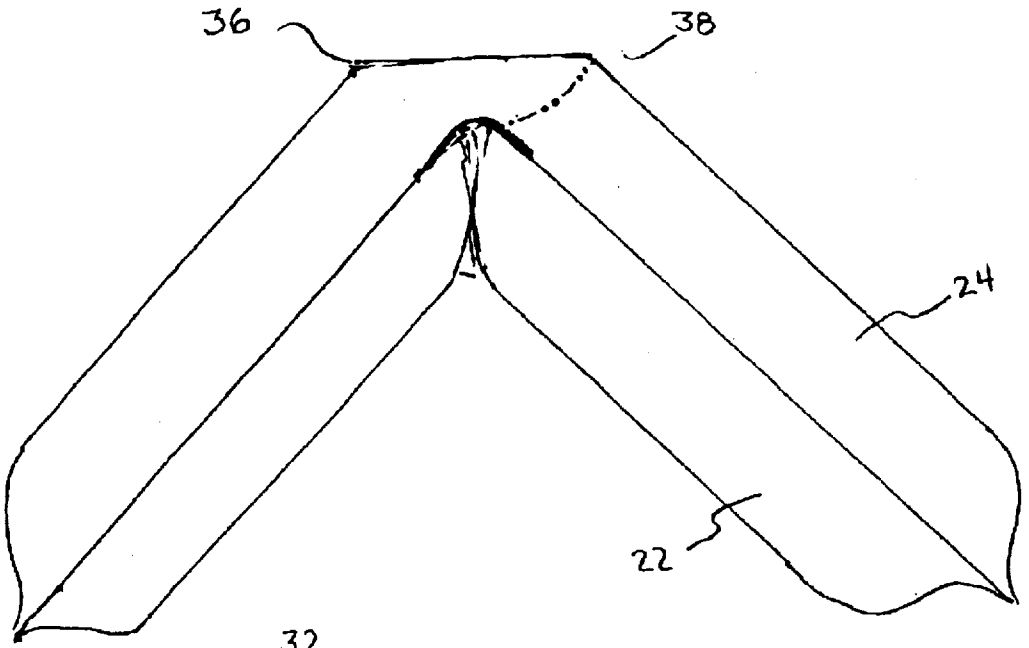
FIGS. 1*a* and 2*b* depict the expandable bladder in accordance with the invention.
Figure 1A:
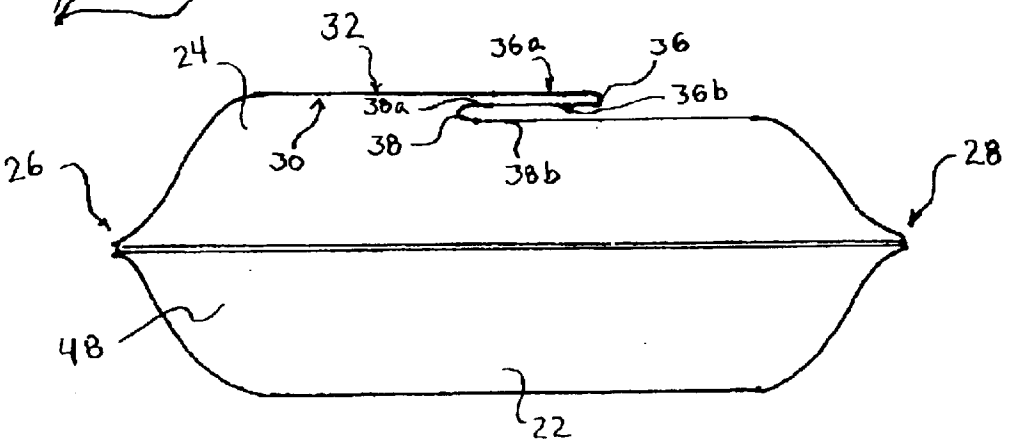

FIG. 1*a* depicts expandable bladder 20 in accordance with the invention. As shown, expandable bladder 20 includes interior sheet 22 and exterior sheet 24, where exterior sheet includes inner side 30 and outer side 32 and where interior and exterior sheets are coupled together to define cavity 48 between them. Generally, interior and exterior sheets, 22 and 24, are of the same material but this need not be necessary for the invention to function properly. All that is needed is for the sheets to be coupled together so that a substance may be inserted and contained in cavity 48. The substance will be more particularly described later.

Expandable bladder 20 further includes a single gusset, defined by first fold 36 and second fold 38, wherein the gusset expands upon bending expandable bladder 20, as shown in FIG. 1*b*. As the gusset expands, exterior sheet 24 is subjected to stretching such that first fold 36 is pulled toward left direction 26 and second fold 38 is pulled toward right direction 28, resulting in the positions of first and second folds, 36 and 38, shown in FIG. 1*b*. Expandable bladder 20 provides additional material within the single gusset so that exterior sheet 24 may open to the position shown in FIG. 1*b*, where a distance between interior and exterior sheets, 22 and 24, is provided. By providing a distance between the sheets, cavity 48 is maintained and may be filled with the substance.

The substance that is placed within cavity 48 to facilitate maintaining a distance between interior sheet 22 and exterior sheet 24 is any fluid, such as air, oil, and/or water or any other material capable of separating interior sheet 22 from exterior sheet 24, such as foam. The substance may be placed between interior sheet 22 and exterior sheet 24 by a port or aperture in any location of bladder 20, in which case the substance may be filled before, during, or after interior and exterior sheets are coupled together. In other embodiments, the substance is placed between interior sheet 22 and exterior sheet 24 prior to or during sealing interior sheet 22 and exterior sheet 24 together, in which case a port may be unnecessary. In still further embodiments, the substance is desired to be filled via a port or aperture, thereby permitting bladder 20 to be filled and unfilled multiple times. It should be known that a single port may be utilized to fill an entire component, the component being described later, or that multiple ports may be utilized to fill selected areas of the component. The substance is not germane to the invention and should not limit the invention in any way.

The prior art suffers a disadvantage of not providing additional material of exterior sheet 24 so that, upon bending of expandable bladder 20, the distance between interior sheet 22 and exterior sheet 24 begins to lessen and may, in some prior art, become zero where exterior sheet 24 touches interior sheet 22. Should this occur, no substance may placed between the interior and exterior sheets and, therefore, there is reduced padding at the bends of expandable bladders of the prior art.

As shown, the single gusset is defined by first fold 36 having first part 36*a* and second part 36*b*, where first part 36*a* of first fold 36 extends from left direction 26 to right direction 28 and second part 36*b* of first fold 36 extends from right direction 28 to left direction 26.

The single gusset is also defined by second fold 38 having first part 38*a* and second part 38*b*, where first part 38*a* of second fold 38 extends from right direction 28 to left direction 26 and second part 38*b* of second fold 38 extends from left direction 26 to right direction 28.

In some embodiments, because exterior sheet 24 is generally of a flexible material to permit bending and does not have any memory, first and second folds 36 and 38 are coupled to interior sheet 22 and/or exterior sheet 24 so that first and second folds 36 and 38 are maintained. In other embodiments, exterior sheet 24 is of a memory retaining material and, hence, first and second folds 36 and 38 need not be coupled to either sheet in order to be maintained.

Figure 2B:
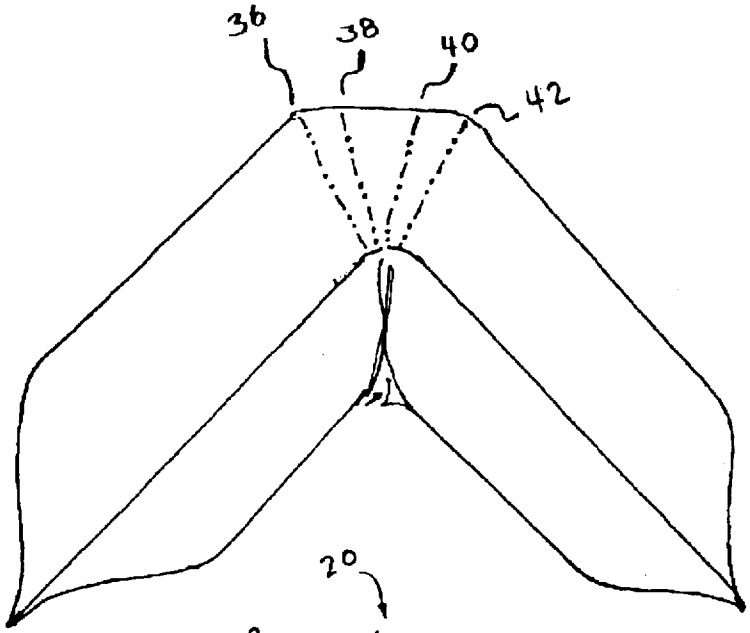
Figure 2A:
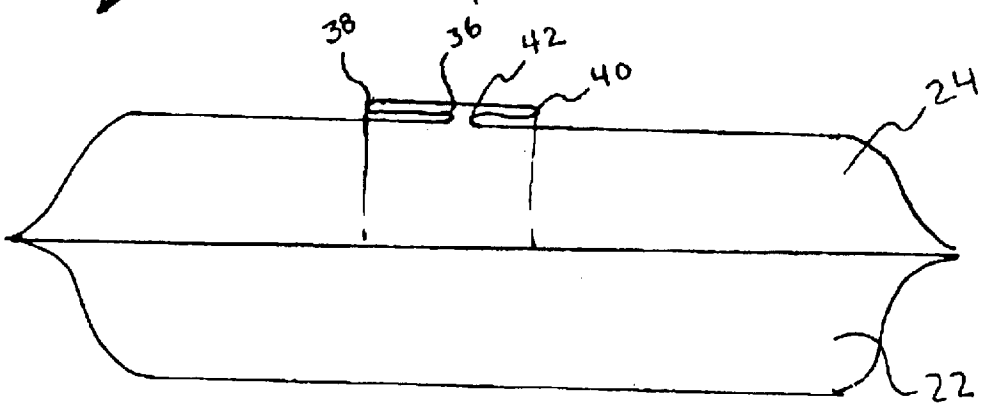

It is understood that expandable bladder 20 includes as few or as many single gussets as desired to facilitate bending. In some embodiments, rather than having multiple single gussets, a lesser amount of gussets may be desired, in which case the double gusset shown in FIGS. 2*a* and 2*b* are preferred. Generally, the double gusset provides twice as much material of exterior sheet 24 as the single gusset and, hence, the amount of gussets may be reduced by approximately 50% when the double gusset is employed. Additionally, the double gusset is particular useful for more severe bending of expandable bladder 20. it is also understood that bladder 20 may be repetitively bent or have the substance filled and/or removed from between interior and exterior sheets, 22 and 24 and bladder 20 will still be capable of providing a distance between the interior and exterior sheets, 22 and 24.

FIG. 2*a* depicts another embodiment of expandable bladder 20 having a double gusset. Expandable bladder 20 includes the single gusset defined by first fold 36 and second fold 38 and as described above. In addition to the single gusset, third fold 40 and fourth fold 42 are provided to complete the double gusset. The double gusset may be viewed to be two consecutive single gussets where the second single gusset is a mirror image of the first single gusset.

Figure 3:
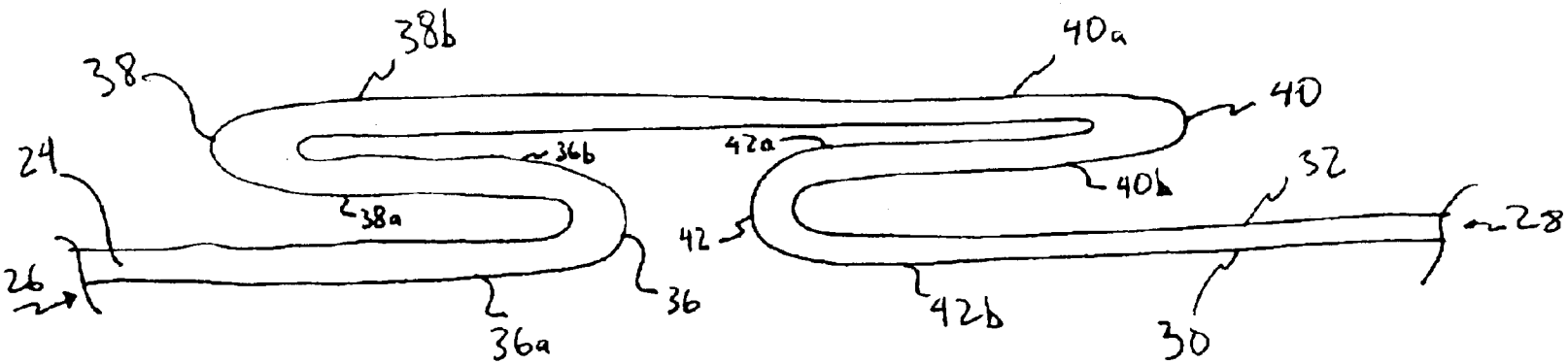
FIG. 3 depicts an exploded view of the double gusset.

As shown in FIGS. 2*a* and 3, third fold 40 includes first part 40*a* and second part 40*b*, where first part 40*a* of third fold 40 extends from left direction 26 to right direction 28 and second part 40*b* of third fold 40 extends from right direction 28 to left direction 26.

Fourth fold 42 includes first part 42*a* and second part 42*b*, where first part 42*a* of fourth fold 42 extends from right direction 28 to left direction 26 and second part 42*b* of second fold 42 extends from left direction 26 to right direction 28.

Similar to the single gusset, as the double gusset expands, exterior sheet 24 is subjected to stretching such that first fold 36 and is pulled toward left direction 26 and fourth fold 42 is pulled toward right direction 28, resulting in the positions of first and fourth folds, 36 and 42, shown in FIG. 2*b*. Expandable bladder 20 provides additional material within the double gusset so that exterior sheet 24 may open to the position shown in FIG. 2*b*, where a distance between interior and exterior sheets, 22 and 24, is provided. By providing a distance between the sheets, cavity 48 is maintained and may be filled with the substance.

Figure 4B:
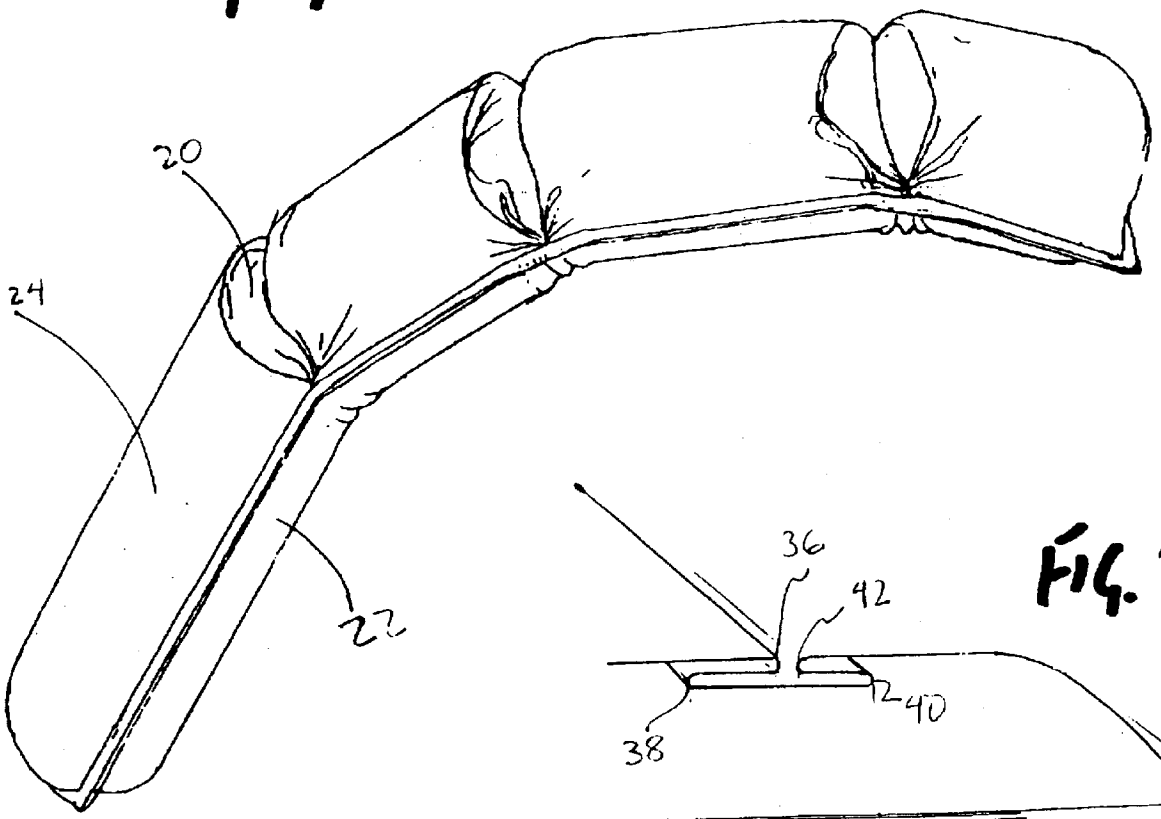
FIGS. 4*a* and 4*b* depict another embodiment of the double gusset.
Figure 4A:
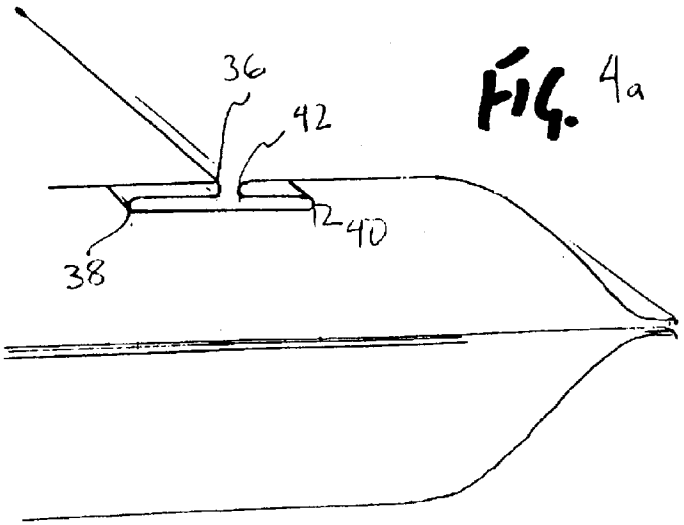

Although the double gusset is shown to have second and third folds, 38 and 40, positioned above first and fourth folds, 36 and 42, the double gusset may be just as effective if second and third folds, 38 and 40, were placed lower than first and fourth folds, 36 and 42, as shown in FIGS. 4*a* and 4*b*.

Expandable bladder 20 may be applied to a variety of components to improve the components' bendability while maintaining a distance between interior and exterior sheets, 22 and 24. The components include a mattress, packaging material, and inflatable structures.

Figure 5:
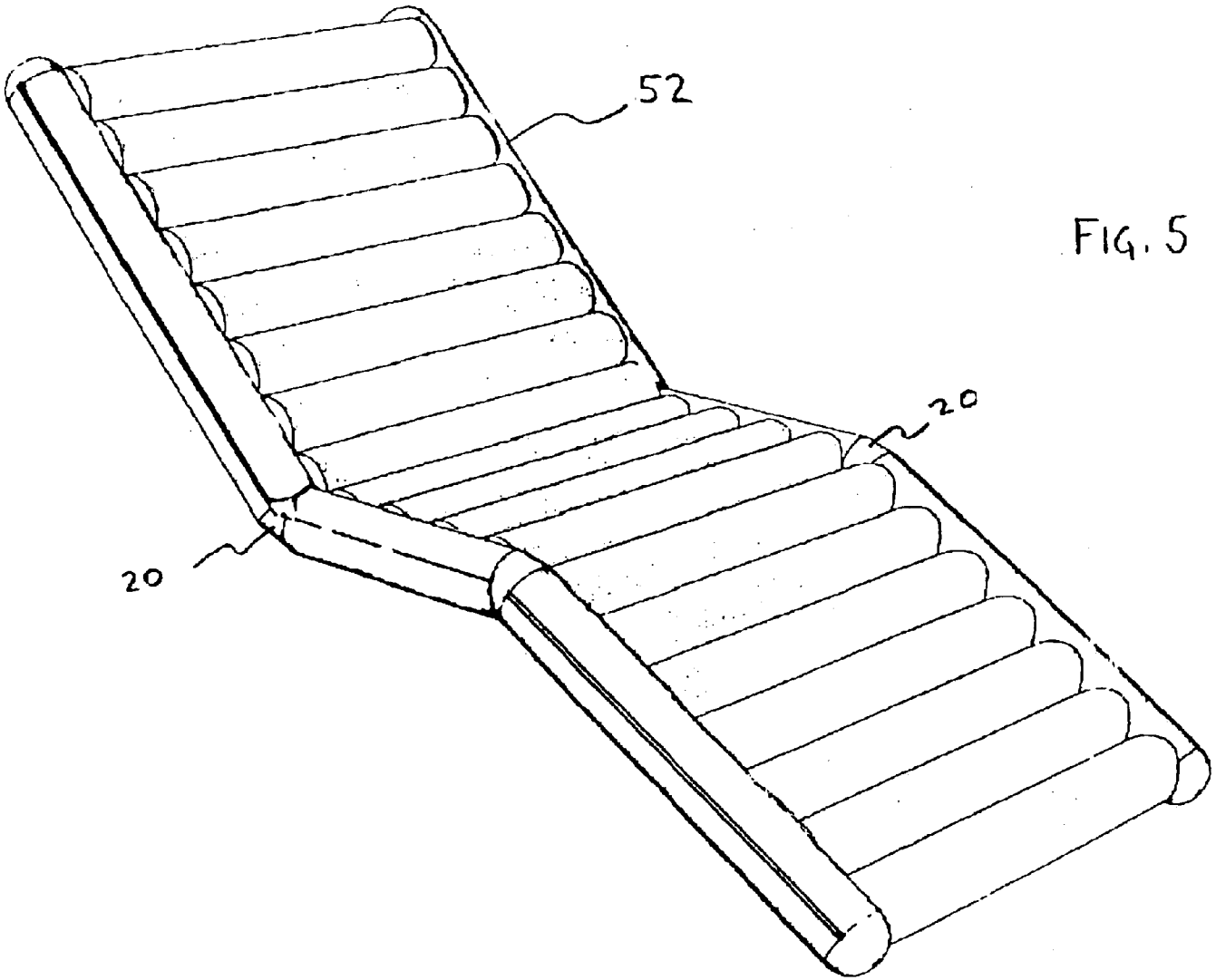
FIG. 5 depicts a mattress having an expandable gusset.

FIG. 5 depicts mattress 52 and expandable bladder 20. Bladder 20 facilitates bending of mattress 52. This is useful for hospital beds where comfort is desired and, if the distance between interior and exterior sheets were not maintained, the user of mattress 52 would encounter areas of reduced support or cushioning in areas where mattress 52 is bent. Bladder 20 is particularly useful in the field of disposable inflatable mattresses, mattress overlays, seat cushions, and back supports, particularly those used for home care and/or long term care and hospital use.

Figure 6:
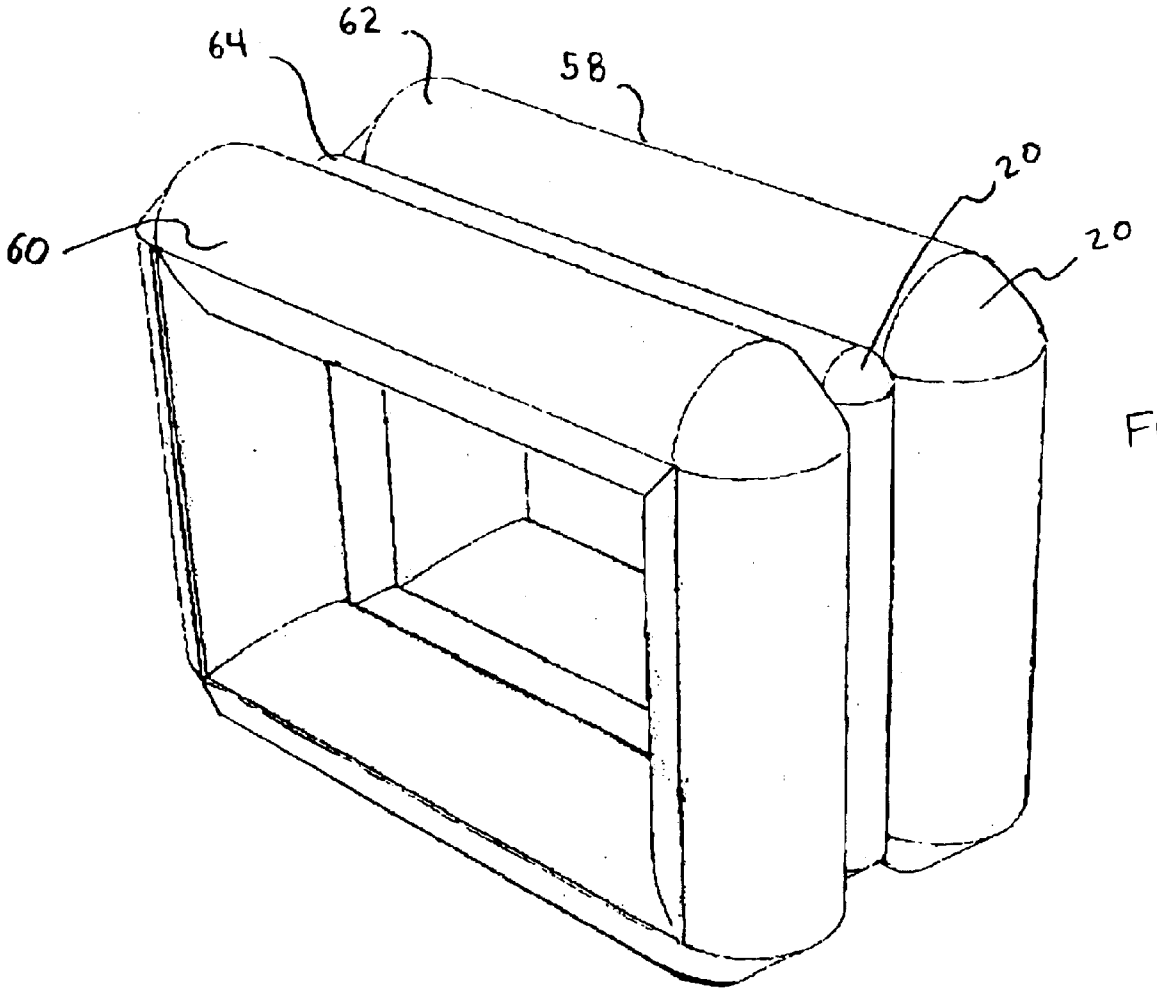
FIG. 6 depicts packaging material having an expandable gusset.
Figure 7:
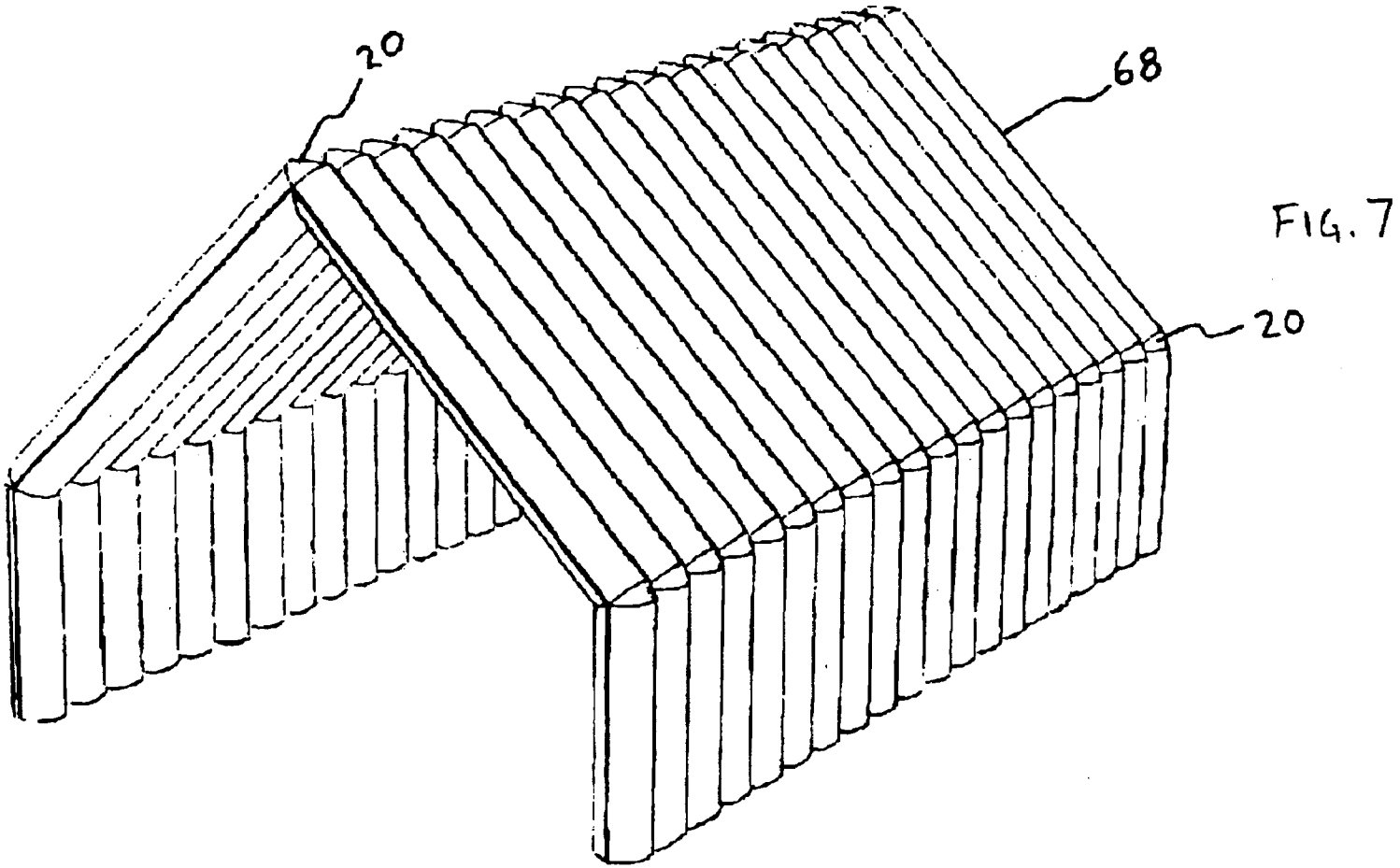
FIG. 7 depicts an inflatable structure having an expandable gusset.

FIG. 6 depicts packaging material 58 and expandable bladder 20, which facilitates bending of packaging material 58. As shown, packaging material are tubular and air filled structures that may be placed within a box for shipping fragile contents. Because of expandable bladder 20, and the distance between interior and exterior sheets that bladder 20 provides, the corners of packaging material 58 are also air filled and helps protect the contents.

Also as shown, packaging material 58 may include variously sized tubular structures so that the contents are positioned toward center tube 64, which is between outer tubes 60 and 62.

Another component that may use bladder 20 is inflatable structure 68, which may be a tent, playhouse, or other structure that is to be bent. Particularly for a playhouse, maintaining a distance between the interior and exterior sheets to provide cushioning is desired. Hence, bladder 20 is particularly useful to achieve this goal while permitting bendability and integrity to structure 68.

Figure 8:
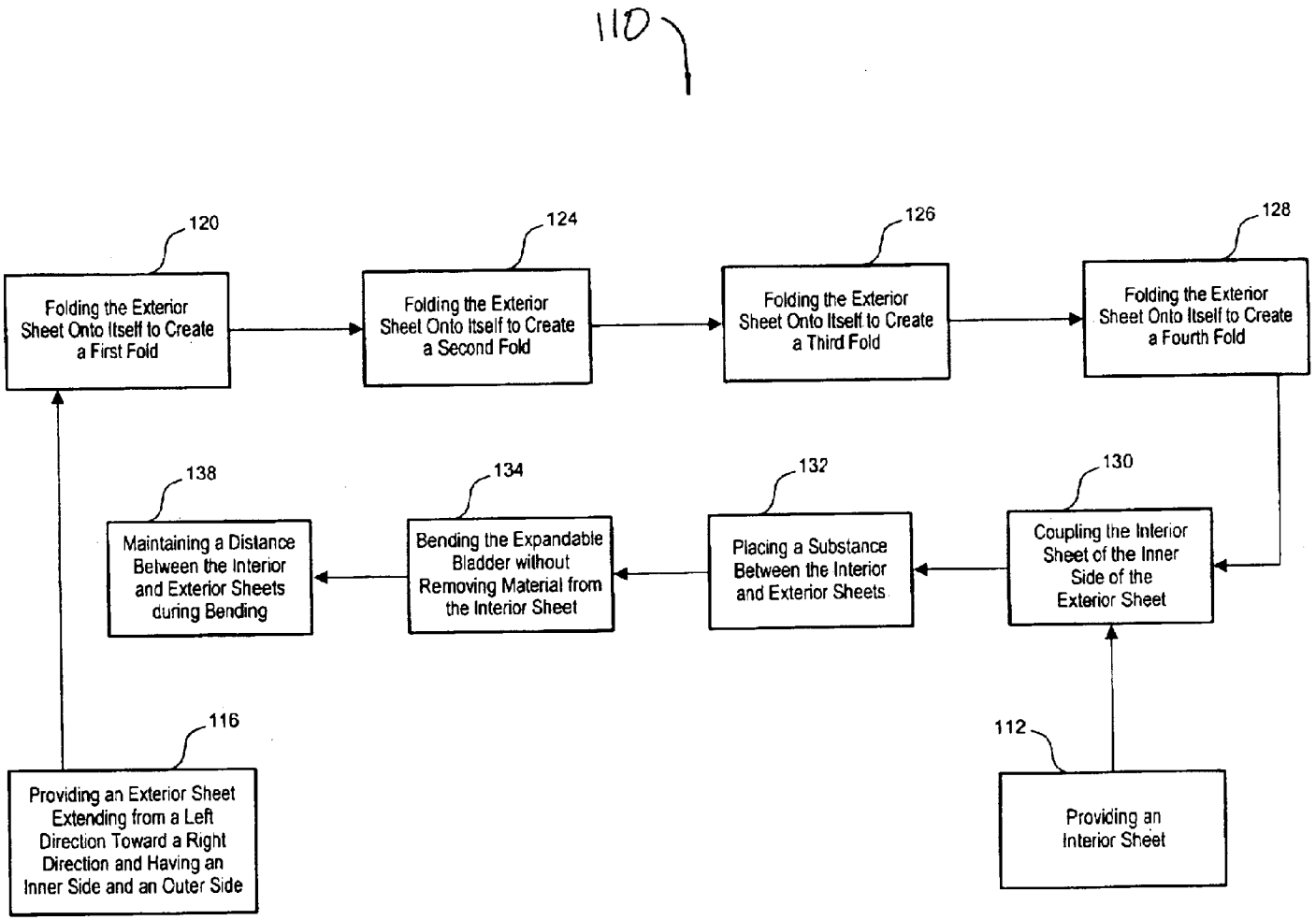
FIG. 8 depicts a method for providing the expandable bladder in accordance with the invention.

FIG. 8 depicts a method 110 for providing an expandable bladder.

including the steps of providing 112 an interior sheet and providing 116 an exterior sheet extending from a left direction toward a right direction and having an inner side and an outer side.

Method 110 further includes the step of folding 120 the exterior sheet onto itself such that a first fold is defined by a first part and a second part, whereby the first part of the first fold extends from a left direction toward a right direction and the second part of the first fold extends from a right direction toward a left direction. Method 110 further includes the step of folding 124 the exterior sheet onto itself after the first fold such that a second fold is defined by a first part and a second part, whereby the first part of the second fold extends from a right direction toward a left direction and the second part of the second fold extends from a left direction toward a right direction. Method 110 also includes coupling 130 the interior sheet to the inner side of the exterior sheet where the outer side is facing upwardly and the inner side is facing downwardly.

In a further embodiment, method 110 may include the step of placing 132 a substance between the interior and exterior sheets to fill the expandable bladder.

In another embodiment, method 110 may include the step of bending 134 the expandable bladder without removing material from the interior sheet. In this embodiment, method 110 maintains 138 a distance between the interior and exterior sheets while bending 134, even repetitively bending, the expandable bladder.

In another embodiment, method 110 may include the step of folding 126 the exterior sheet onto itself after the second fold such that a third fold is defined by a first part and a second part and the second part, whereby the first part of the third fold extends from a left direction toward a right direction and the second part of the third fold extends from a right direction toward a left direction.

In a further embodiment, method 110 may include the step of folding 128 the exterior sheet onto itself after the third fold such that a fourth fold is defined by a first part and a second part, whereby the first part of the fourth fold extends from a right direction toward a left direction and the second part of the fourth fold extends from a left direction toward a right direction.

Figure 9:
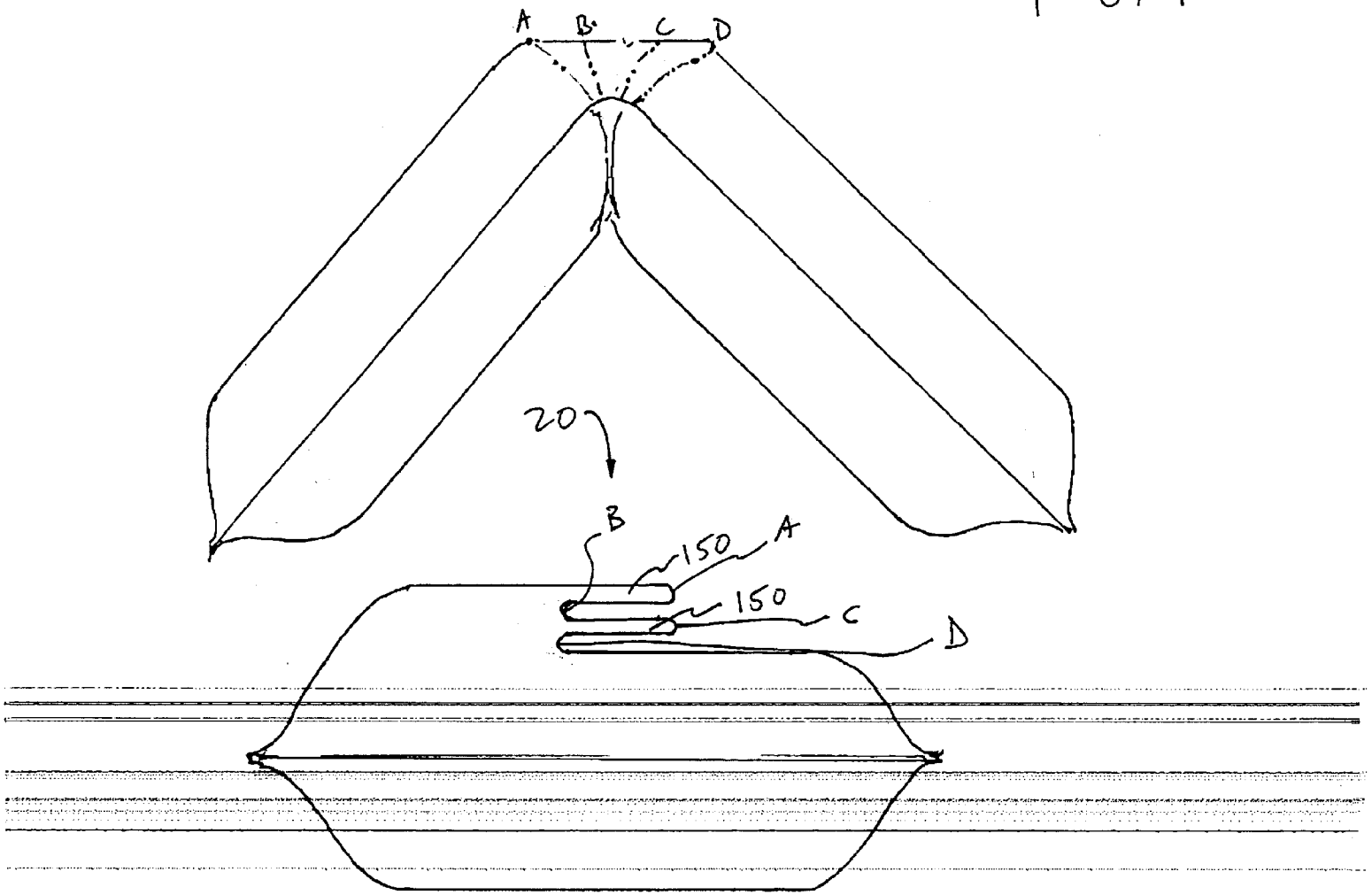
FIG. 9 depicts another embodiment of the expandable bladder.

FIG. 9 shows another embodiment of the invention having stacked gussets. Bladder 20 includes a plurality of gussets in tandem, or stacked, with one another. Each gusset 150 has the same limitations of the single gusset or double gusset as described above. As shown, a plurality of single gussets are depicted each having a first fold and a second fold. In further embodiments of the embodiment shown in FIG. 9, a third fold and a fourth fold may also be included with each gusset to define a plurality of double gusset. The limitations for the first, second, third, and fourth folds are as described above.

Although the invention has been described with reference to a particular arrangement of parts, features and the like, these are not intended to exhaust all possible arrangements or features, and indeed any other modifications and variations will be ascertainable to those of skill in the art.

What is claimed is:

1. An expandable bladder, comprising:

an interior sheet;

an exterior sheet extending from a left direction toward a right direction and having an inner side and an outer side;

said interior sheet being coupled to said inner side of said exterior sheet where said outer side is facing upwardly and said inner side is facing downwardly;

said exterior sheet having a first fold defined by a first part and a second part and said second part of said first fold is folded onto said first part of said first fold, whereby said first part of said first fold extends from a left direction toward a right direction and said second part of said first fold extends from a right direction toward a left direction;

said exterior sheet having a second fold following said first fold, said s and fold defined by a first part and a second part and said second part of said second old is folded onto said first part of said second fold, whereby said first part of said second fold extends from a right direction toward a left direction and said second part of said second fold extends from a left direction toward a right direction; and said interior sheet is without a fold;

wherein said exterior sheet, when subject to bending, lengthens to accommodate the bending without coming in contact with said interior sheet in the are of the bend due to said first and said second folds becoming unfolded; and wherein said exterior sheet and said interior sheet are spaced-apart in the area of the bend without an aid.

2. The expandable bladder according to claim 1, wherein said first and second folds are coupled to said interior sheet.

3. The expandable bladder according to claim 1, wherein said first and second folds are cyclically repetitive along said exterior sheet.

4. The expandable bladder according to claim 1, wherein said outer side of said first and second folds face upwardly and said inner side of said first and second folds face downwardly when a substance is placed between said interior and exterior sheets and, when said interior and exterior sheets are subjected to bending, said interior and exterior sheets provide a space between them.

5. The expandable bladder according to claim 1, wherein said interior and exterior sheets are coupled to a component selected from the group consisting of a mattress, packaging material, and inflatable structure.

6. An expandable bladder, comprising:

an interior sheet;

an exterior sheet extending from a left direction toward a right direction and having an inner side and an outer side;

said interior sheet being coupled to said inner side of said exterior sheet where said outer side is facing upwardly and said inner side is facing downwardly;

said exterior sheet having a first fold defined by a first part and a second part and said second part of said first fold is folded onto said first part of said first fold, whereby said first part of said first fold extends from a left direction toward a right direction and said second part of said first fold extends from a right direction toward a left direction;

said exterior sheet having a second fold following said first fold, said second fold defined by a first part and a second part and said second part of said second fold is folded onto said first part of said second fold, whereby said first part of said second fold extends from a right direction toward a left direction and said second part of said second fold extends from a left direction toward a right direction;

said exterior sheet having a third fold following said second fold, said third fold defined by a first part and a second part and said second part of said third fold is folded onto said first part of said third fold, whereby said first part of said third fold extends from a left direction toward a right direction and said second part of said third fold extends from a right direction toward a left direction;

said exterior sheet having a fourth fold following said third fold, said fourth fold defined by a first part and a second part and said second part of said fourth fold is folded onto said first part of said fourth fold, whereby said first part of said fourth fold extends from a right direction toward a left direction and said second part of said fourth fold extends from a left direction toward a right direction; and said interior sheet is without a fold;

wherein said exterior sheet, when subject to bending, lengthens to accommodate the bending without coming in contact with said interior sheet in the area of the bend due to said first and said second folds becoming unfolded; and wherein said exterior sheet and said interior sheet are spaced-apart in the area of the bend without an aid.

7. The expandable bladder according to claim 6, wherein said first second, third, and fourth folds are coupled to said interior sheet.

8. The expandable bladder according to claim 6, wherein said first, second, third, and fourth folds are cyclically repetitive along said exterior sheet.

9. The expandable bladder according to claim 6, wherein said outer side of said first, second, third, and fourth folds face upwardly and said inner side of said first, second, third, and fourth folds face downwardly when a substance is placed between said interior and exterior sheets and, when said interior and exterior sheets are subjected to bending, said interior and exterior sheets provide a space between them.

10. The expandable bladder according to claim 6, wherein said interior and exterior sheets are coupled to a component selected from the group consisting of a mattress, packaging material, and inflatable structure.

11. A method for providing an expandable bladder, comprising the steps of providing an interior sheet without a fold;

providing an exterior sheet extending from a left direction toward a right direction and having an inner side and an outer side;

folding the exterior sheet onto itself such that a first fold is defined by first part and a second part, whereby the first part of the first fold extends from a left direction toward a right direction and the second part of the first fold extends from a right direction toward a left direction;

folding the exterior sheet onto itself after the first fold such that a second fold is defined by a first part and a second part, whereby the first part of the second fold extends from a right direction toward a left direction and the second part of the second fold extends from a left direction toward a right direction;

coupling the interior sheet to the inner side of the exterior sheet where the outer side is facing upwardly and the inner side is facing downwardly;

accommodating a bend in the interior and exterior sheets by unfolding the exterior sheet so that the exterior sheet does not contact the interior sheet in the area of the bend; and spacing the exterior sheet apart from the interior sheet in the area of the bind without an aid.

12. The method according to claim 11, further comprising the step of placing a substance between the interior and exterior sheets to fill the expandable bladder.

13. The method according to claim 12, further comprising the step of bending the expandable bladder without removing material from the interior sheet.

14. The method according to claim 13, further comprising the step of maintaining a distance between the interior and exterior sheets while bending the expandable bladder.

15. The method according to claim 11, further comprising the of folding the exterior sheet onto itself after the second fold such that a third fold is defined by a first part and a second part and the second part, whereby the first part of the third fold extends from a left direction toward a right direction and the second part of the third fold extends from a right direction toward a left direction.

16. The method according to claim 15, further comprising the step of folding the exterior sheet onto itself after the third fold such that a fourth fold is defined by a first part and a second part, whereby the first part of the fourth fold extend from a right direction toward a left direction and the second part of the fourth fold extends from a left direction toward a right direction.

17. The method according to claim 16, further comprising the step of bending the expandable bladder without removing material from the interior sheet.

18. The method according to claim 16, further comprising the step of maintaining a distance between the interior and exterior sheets while bending the expandable bladder.

* * * * *